US011577176B2

(12) United States Patent
Ye

(10) Patent No.: US 11,577,176 B2
(45) Date of Patent: Feb. 14, 2023

(54) SPLICING STRUCTURE

(71) Applicant: WIST PLASTIC & METAL TECHNOLOGY LIMITED, Guangdong (CN)

(72) Inventor: Zuwei Ye, Guangdong (CN)

(73) Assignee: WIST PLASTIC & METAL TECHNOLOGY LIMITED, Guangdong (CN)

( * ) Notice: Subject to any disclaimer, the term of this patent is extended or adjusted under 35 U.S.C. 154(b) by 0 days.

(21) Appl. No.: 16/957,368

(22) PCT Filed: Dec. 5, 2018

(86) PCT No.: PCT/CN2018/119256
§ 371 (c)(1),
(2) Date: Jun. 23, 2020

(87) PCT Pub. No.: WO2019/134476
PCT Pub. Date: Jul. 11, 2019

(65) Prior Publication Data

US 2020/0346129 A1 Nov. 5, 2020

(30) Foreign Application Priority Data

Jan. 2, 2018 (CN) ..... 201810002176.9

(51) Int. Cl.
*A63H 33/10* (2006.01)

(52) U.S. Cl.
CPC ..... *A63H 33/108* (2013.01); *A63H 33/107* (2013.01)

(58) Field of Classification Search
CPC .... A63H 33/10; A63H 33/101; A63H 33/107; A63H 33/108; A63H 33/102
USPC ..... 446/85, 121, 122, 124, 128
See application file for complete search history.

(56) References Cited

U.S. PATENT DOCUMENTS 2,885,822 A * 5/1959 Onanian ..... A63H 33/101 174/138 D
3,195,266 A * 7/1965 Onanian ..... A63H 33/101 52/603
3,681,870 A * 8/1972 Alpert ..... A63H 33/108 446/122
4,551,110 A * 11/1985 Selvage ..... A63H 33/101 411/509
4,813,903 A * 3/1989 Furukawa ..... A63H 33/042 446/104
4,823,532 A * 4/1989 Westerburgen ..... A63H 33/08 446/128
5,322,466 A * 6/1994 Bolli ..... A63H 33/042 24/453

(Continued)

*Primary Examiner* — Alexander R Niconovich
(74) *Attorney, Agent, or Firm* — Houtteman Law LLC

(57) ABSTRACT

A splicing structure is disclosed, and the splicing structure includes at least two splicing blocks which are detachably spliced together, a splicing hole is arranged in one of the two splicing blocks which are spliced with each other, the other splicing block is provided with a splicing column which can be inserted into the splicing hole, and the splicing column is provided with an inner hole extending in an axial direction thereof. The splicing structure further includes: a plug piece having an insertion rod; a receptacle having a sleeve, where an insertion hole is formed on the sleeve.

87 Claims, 12 Drawing Sheets

(56) References Cited

U.S. PATENT DOCUMENTS

| | | | | |
|---|---|---|---|---|
| 5,924,906 | A * | 7/1999 | Grafton | A63H 33/10 446/124 |
| 6,050,873 | A * | 4/2000 | Reisman | A63H 33/062 446/128 |
| 6,736,691 | B1 * | 5/2004 | Bach | A63H 33/101 446/116 |
| 7,517,270 | B2 * | 4/2009 | Marzetta | A63H 33/101 446/85 |
| 7,736,211 | B2 * | 6/2010 | Marzetta | A63H 33/106 446/85 |
| 8,905,812 | B2 * | 12/2014 | Pai-Chen | A63H 33/107 446/124 |
| 9,010,059 | B2 * | 4/2015 | Lin | A63H 33/107 52/603 |
| 9,044,690 | B2 * | 6/2015 | Uttley | A63H 33/102 |
| 9,839,860 | B2 * | 12/2017 | Rakhsha | A63H 33/04 |
| 10,758,836 | B2 * | 9/2020 | Akishbekov | A63H 33/042 |
| 10,888,797 | B2 * | 1/2021 | De Wilde | F16B 12/26 |
| 2006/0194505 | A1 * | 8/2006 | Rolf | A63H 33/086 446/118 |
| 2008/0075528 | A1 * | 3/2008 | Marzetta | A63H 33/108 403/238 |
| 2018/0369707 | A1 * | 12/2018 | Ryu | A63H 33/107 |

* cited by examiner

SPLICING STRUCTURE

The present application claims priority to Chinese Patent Application No. 201810002176.9 filed on Jan. 2, 2018, the disclosure of which is hereby incorporated by reference in its entirety as part of the present application.

TECHNICAL FIELD

This disclosure relates to the fields of tool/handicraft/furniture/toy, particularly to a splicing structure by splicing blocks together to form a certain plane shape/spatial shape/stereochemical structure, and the splicing structure may be a splicing toy, a handicraft, furniture, etc.

BACKGROUND ART

Due to its assembly convenience and reusability, the splicing structure has been widely applied in various fields, such as tool, handicraft, furniture and toy. The application in the field of splicing toys is set as an example; the splicing structure is enjoyed by large numbers of players due to its extremely strong interestingness. Moreover, the splicing structure plays a rather positive role in improving cognition, imagination, creativity, practical ability, etc., therefore, it has been widely used as an enlightenment education tool for children in recent years.

For example, such type of splicing toy has been disclosed in patent documents, such as CN101132842A and CN105792905A. The splicing toys disclosed in these documents are provided with a plurality of plastic splicing blocks, and a concave splicing hole is formed in one of the two splicing blocks spliced with each other; a convex splicing column is formed in the other splicing block, and the splicing column and the splicing hole are spliced with each other to integrate the plurality of splicing blocks.

SUMMARY OF THE INVENTION

However, for the conventional splicing structure, the splicing hole and splicing column usually serve as a connecting-fixing structure; during assembly, the splicing column is inserted into the splicing hole to achieve the positioning and fixation between splicing blocks by means of the binding force between the splicing column and the splicing hole merely. Such kind of fixing way is not only unfirm, but also demands for higher machining precision. In addition, the positioning and fixation between splicing blocks are achieved by the binding force between the splicing column and the splicing hole, so that the material of the splicing structure for manufacturing the splicing block is limited greatly, plastic is widely used as the manufacturing material of the splicing block in the conventional splicing structure, resulting in a single product, which may not satisfy people's requirements on the diversity of products.

In view of this, the splicing structure is made by the inventor of the disclosure with diversified materials, including metallic materials and non-metallic materials, thus achieving the diversity of products while ensuring reliable connection and fixation among splicing blocks as well as reducing the machining precision of splicing blocks. The disclosure is exactly proposed in view of the above-mentioned practical situation, and aims to provide a splicing structure capable of solving one or more of the following technical problems:

realization of product diversity;

easy plug-in/out among splicing blocks, firm splicing, capable of achieving firm splicing after long-term use;

improvement in mass production of the splicing blocks.

In order to achieve the above-mentioned purpose, a splicing structure of the disclosure includes at least two splicing blocks which are detachably spliced together, a splicing hole is arranged in one of the two splicing blocks which are spliced with each other, the other splicing block is provided with a splicing column which can be inserted into the splicing hole, and the splicing column is provided with an inner hole extending in an axial direction thereof; the splicing structure further includes: a plug piece having an insertion rod; a receptacle having a sleeve, where an insertion hole is formed on the sleeve; the plug piece is fixedly mounted in one of the inner hole of the splicing column and the splicing hole, and the receptacle is fixedly mounted in the other of the inner hole of the splicing column and the splicing hole; when the two splicing blocks are spliced by inserting the splicing column into the splicing hole, the insertion rod is inserted into the insertion hole by an interference fit to firmly joint the two splicing blocks together.

In one embodiment, the plug piece is fixedly mounted in the splicing hole and the receptacle is fixedly mounted in the inner hole of the splicing column.

In one embodiment, the one splicing block is further provided with the splicing column, and the receptacle is fixedly mounted in the inner hole of the splicing column.

In one embodiment, the other splicing block is further provided with the splicing hole, and the plug piece is fixedly mounted in the splicing hole.

In one embodiment, the splicing hole and splicing column on the same splicing block are arranged coaxially, the inner hole of the splicing column is communicated with and coaxial with the splicing hole, and the receptacle in the inner hole is integrally formed with the plug piece in the splicing hole.

In one embodiment, the sleeve of the receptacle is inserted into the inner hole and fixed by interference fit between the sleeve and the inner hole, and wall of the inner hole is a rough surface.

In one embodiment, an inwardly-pointed annular flange is formed on an end portion, away from the splicing hole, of the splicing column.

In one embodiment, an outwardly-pointed annular flange is formed in a portion where the receptacle and the plug piece are connected with each other, and the annular flange is abutted against a step surface between the inner hole of the splicing column and the splicing hole after assembly.

In one embodiment, an inwardly-pointed annular flange is formed on an end portion in side of the inner hole, close to the splicing hole, of the splicing column, and an end face of the side, connected with the plug piece, of the sleeve of the receptacle is abutted against on the annular flange after assembled.

In one embodiment, cross-sectional outline of the sleeve of the receptacle is polygonal, and the inner hole is a round hole.

In one embodiment, junction of two adjacent sides in the cross-sectional outline of the polygon forms a circular arc.

In one embodiment, curvature radius of the circular arc is equal to or slightly greater than radius of the inner hole.

In one embodiment, the insertion hole of the receptacle is polygonal.

In one embodiment, the cross-sectional outline of the sleeve is a polygon similar to the insertion hole, the corresponding sides of the both two are parallel to each other.

In one embodiment, the cross-sectional outline of the sleeve of the receptacle is a square, and the insertion hole of the receptacle is inequilaterally octagonal; inequilateral octagon includes four long sides with equal length and four short sides with equal length, each of long sides is respectively parallel to each side of the square outline of the sleeve of the receptacle.

In one embodiment, the insertion rod is a cylindrical rod.

In one embodiment, the sleeve of the receptacle is inserted into the inner hole of the splicing column, and fixed by interference fit between the sleeve and the inner hole.

In one embodiment, the other splicing block is further provided with the other splicing column, and the receptacle is fixedly mounted in the inner hole of each splicing column.

In one embodiment, the sleeve of the receptacle is inserted into the inner hole of the splicing column, and fixed by interference fit between the sleeve and the inner hole.

In one embodiment, splicing columns arranged on the other splicing block are arranged coaxially, and inner holes of the two coaxially-arranged splicing columns are communicated with each other via an intercommunicating hole, and the intercommunicating hole is coaxial with the inner hole and its diameter is equal to or more than that of the inner hole, the sleeve of the receptacle is inserted into the inner hole of the splicing column and the intercommunicating hole, and is fixed by interference fit between the sleeve and the inner hole and/or the intercommunicating hole.

In one embodiment, the plug piece includes a flange fixed on one end of the insertion rod, and the flange is inserted into the splicing hole, and the plug piece is fixed by interference fit between the flange and the splicing hole.

In one embodiment, the one splicing block is further provided with the other splicing hole, and plastic plug piece is fixedly mounted in each splicing hole.

In one embodiment, the plug piece includes a flange fixed on one end of the insertion rod, and the flange is inserted into the splicing hole, and the plug piece is fixed by interference fit between the flange and the splicing hole.

In one embodiment, splicing holes separately arranged on the one splicing block are arranged coaxially, and the two coaxially-arranged splicing holes are communicated with each other via an intercommunicating hole; the plug piece includes a cylindrical portion located centrally and an insertion rod stretching out from both sides of the cylindrical portion respectively, and each insertion rod is coaxial with the cylindrical portion; the cylindrical portion of the plug piece is inserted into the intercommunicating hole, and is fixed by interference fit between the cylindrical portion and the intercommunicating hole.

In one embodiment, the plug piece includes the insertion rod and a cap member, and the cap member includes a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

In one embodiment, the splicing hole is respectively arranged at both sides of the one splicing block, and plastic plug piece is fixedly mounted in each splicing hole.

In one embodiment, the plug piece includes the insertion rod and a cap member, and the cap member includes a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

In one embodiment, the plug piece is fixedly mounted in the inner hole of the splicing column, and the receptacle is fixedly mounted in the splicing hole.

In one embodiment, the one splicing block is further provided with the splicing column, the plug piece is fixedly mounted in the inner hole of the splicing column.

In one embodiment, the other splicing block is further provided with the splicing hole, and the receptacle is fixedly mounted in the splicing hole.

In one embodiment, the splicing hole and splicing column on the same splicing block are arranged coaxially, the inner hole of the splicing column is communicated with and coaxial with the splicing hole, and the plug piece in the inner hole is integrally formed with the receptacle in the splicing hole.

In one embodiment, an outwardly-pointed annular flange is formed in a portion where the receptacle and the plug piece are connected with each other, the annular flange is inserted into the splicing hole or the inner hole by interference fit to fix the receptacle and the plug piece on the splicing block.

In one embodiment, the inner wall of the splicing hole or the inner hole is a rough surface.

In one embodiment, cross-sectional outline of the annular flange is a polygon.

In one embodiment, the splicing hole or the inner hole is a round hole.

In one embodiment, junction of two adjacent sides in the cross-sectional outline of the polygon forms a circular arc, curvature radius of the circular arc is roughly the same as radius of the splicing hole or the inner hole.

In one embodiment, the cross-sectional outline of the receptacle is a polygon similar to the insertion hole of the receptacle, the corresponding sides of the both two are parallel to each other.

In one embodiment, the polygon is a square.

In one embodiment, the insertion rod is a cylindrical rod.

In one embodiment, a portion, close to the plug piece, of the sleeve of the receptacle, is inserted into the inner hole of the splicing column by interference fit, thus making the receptacle and plug piece fixed on the splicing block; the inner wall of the portion, matched to the sleeve, of the inner hole of the splicing column is a rough surface.

In one embodiment, cross-sectional outline of the sleeve of the receptacle is a polygon, and junction of two adjacent sides in the cross-sectional outline of the polygon forms a circular arc, and curvature radius of the circular arc is roughly the same as radius of the inner hole of the splicing column.

In one embodiment, the insertion hole of the receptacle is a polygonal hole.

In one embodiment, the cross-sectional outline of the sleeve is a polygon similar to the polygonal hole, and the corresponding sides of the both two are parallel to each other.

In one embodiment, the cross-sectional outline of the sleeve of the receptacle is a square, and the insertion hole of the receptacle is inequilaterally octagonal; inequilateral octagon includes four long sides with equal length and four short sides with equal length, each of long sides is respectively parallel to each side of the square outline of the sleeve of the receptacle.

In one embodiment, a flange is arranged on an inner end of the sleeve of the receptacle, and the flange is inserted into the splicing hole, and the receptacle is fixed by interference fit between the flange and the splicing hole.

In one embodiment, the one splicing block is further provided with the other splicing hole, and plastic receptacle is fixedly mounted in each splicing hole.

In one embodiment, a flange is arranged on an inner end of the sleeve of the receptacle, and the flange is inserted into the splicing hole, and the receptacle is fixed by interference fit between the flange and the splicing hole.

In one embodiment, splicing holes separately arranged on the one splicing block are arranged coaxially, and the two coaxially-arranged splicing holes are communicated with each other via an intercommunicating hole; the intercommunicating hole is coaxial with the splicing hole and its diameter is equal to or smaller than that of the splicing hole; the receptacle includes a cylindrical portion located centrally and sleeves stretching out from both sides of the cylindrical portion respectively, each sleeve is coaxial with the cylindrical portion, and the cylindrical portion of the receptacle is inserted into the intercommunicating hole, and is fixed by interference fit between the cylindrical portion and the intercommunicating hole.

In one embodiment, the plug piece includes a flange fixed on one end of the insertion rod, and the flange is inserted into the inner hole of the splicing column, and the plug piece is fixed by interference fit between the flange and the inner hole.

In one embodiment, the other splicing block is further provided with the other splicing column, and plastic plug piece is fixedly mounted in the inner hole of each splicing column.

In one embodiment, the plug piece includes a flange fixed on one end of the insertion rod, and the flange is inserted into the inner hole of the splicing column, and the plug piece is fixed by interference fit between the flange and the inner hole.

In one embodiment, splicing columns separately arranged on the other splicing block are arranged coaxially, and inner holes of the two coaxially-arranged splicing columns are communicated with each other via an intercommunicating hole; the intercommunicating hole is coaxial with the inner hole and its diameter is equal to or smaller than that of the inner hole; the plug piece includes a cylindrical portion located centrally and insertion rods stretching out from both sides of the cylindrical portion respectively, each insertion rod is coaxial with the cylindrical portion, and the cylindrical portion of the plug piece is inserted into the intercommunicating hole, and is fixed by interference fit between the cylindrical portion and the intercommunicating hole.

In one embodiment, each of the two mutually-spliced splicing blocks is provided with a splicing hole and a splicing column, and the two splicing blocks may be spliced by position exchange.

In one embodiment, the plug piece and the receptacle are made of plastic or soft wood.

In one embodiment, the plug piece and/or the receptacle are integrally formed with the splicing block.

In one embodiment, the receptacle and/or plug piece are fixed by interference fit and/or adhesive bonding.

In one embodiment, the splicing block is made of metallic or non-metallic material.

In one embodiment, cross-sectional outline of the sleeve of the receptacle is a polygon.

In one embodiment, junction of two adjacent sides in cross-sectional outline of polygon forms a circular arc.

In one embodiment, the insertion hole of the receptacle is polygonal.

In one embodiment, cross-sectional outline of the sleeve is a polygon similar to the insertion hole, the corresponding sides of both two are parallel to each other.

In one embodiment, the cross-sectional outline of the sleeve of the receptacle is a square, and the insertion hole of the receptacle is inequilaterally octagonal; inequilateral octagon includes four long sides with equal length and four short sides with equal length, each of long sides is respectively parallel to each side of the square outline of the sleeve of the receptacle.

In one embodiment, the insertion plug rod is a cylindrical rod, when two splicing blocks are spliced together, the cylindrical rod contacts with each sideline of the polygonal insertion hole.

By the technical solution of this disclosure, the splicing block may be made from a plurality of materials, which greatly improves the diversity of products, and ensures reliable connection and fixation between the splicing blocks, moreover, reduces the machining precision requirement of the splicing blocks, thus achieving good technical effect.

BRIEF DESCRIPTION OF THE DRAWINGS

To specify the technical solution of embodiments of this disclosure more clearly, drawings of the embodiments will be described below briefly. Apparently, the drawings described hereby merely relate to some embodiments of this disclosure, but not intended to limit the disclosure.

DETAILED DESCRIPTION OF THE INVENTION

To make the objective, technical solution and advantages of the embodiments of this disclosure more clearly, the technical solution of embodiments of the disclosure will be described clearly and completely with reference to the drawings. Obviously, the described embodiments are merely a part of the embodiments of this disclosure, but not all of the embodiments. Based upon the embodiments of the disclosure, all other embodiments obtained by those skilled in the art without any inventive effort shall fall within the protection scope of the disclosure.

First Embodiment

Hereinafter, the first embodiment of the disclosure is described with reference to FIG. 1A-FIG. 4.

[Structure]

Figure 1A:
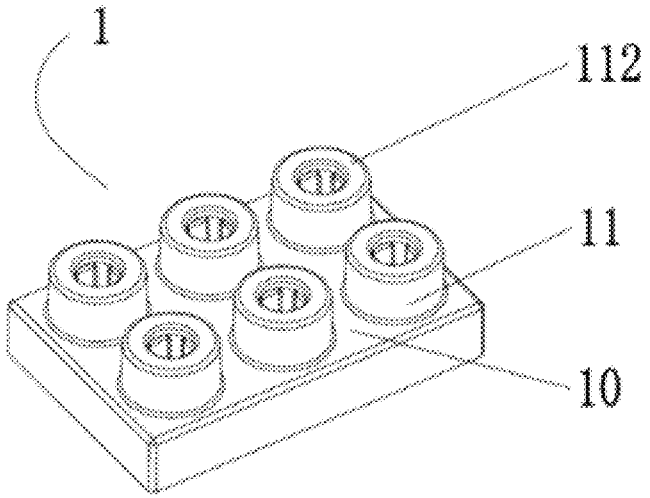
FIG. 1A is a space diagram showing a structure of a splicing block of a splicing structure in a first embodiment.
Figure 1B:
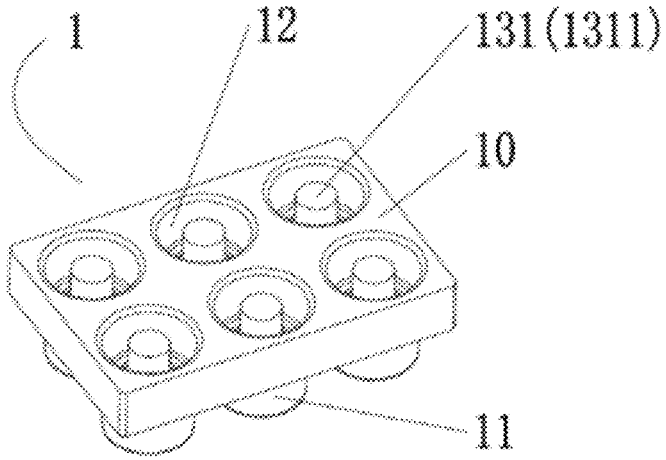
FIG. 1B is a space diagram showing a structure of the splicing structure of the splicing structure in the first embodiment when viewed from the other angle.
Figure 1C:
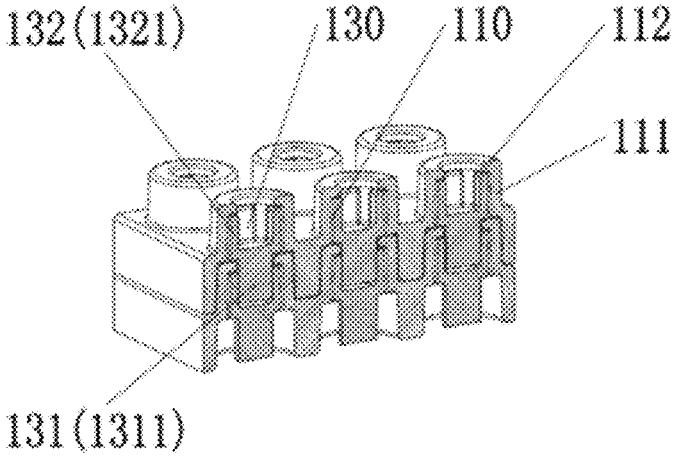
FIG. 1C shows a cross-sectional view of a splicing block when spliced together in the first embodiment.

The splicing structure of the embodiment has a plurality of splicing block 1 as shown in FIGS. 1A, 1B and 1C, and these splicing blocks 1 are detachably spliced with each other to form the required splicing structure. As specific examples of the splicing structure, for example, it may be a toy, a tool, furniture, handicraft, etc.

As the material for forming the splicing block 1, there is no specific limitation in the disclosure, and it may be a metal material or non-metallic material. As the metal material for forming the splicing block 1, it may be any metal material suitable for making the splicing block 1, including but not limited to iron, steel, aluminum, copper, aluminum alloy, copper alloy, etc. As the non-metallic material for forming the splicing block 1, it may be any non-metallic material suitable for making the splicing block 1, including but not limited to wood, glass, ceramic, plastic, etc.

As shown in FIGS. 1A-3, the splicing block 1 has a body portion 10, multiple groups of one-to-one splicing columns 11 and splicing holes 12 and splicing assembly 13 formed on the body portion 10.

The body portion 10 is cuboid-shaped. In order to prevent sharp corners of the body portion 10 from scratching the user, corner portions of the body portion 10 may be processed into chamfers.

Splicing columns 11 are integrally formed on the body portion 10, and a plurality of splicing columns 11 are distributed on the body portion 10 at intervals in a matrix shape. Each of the splicing columns 11 has a cylindrical portion 111 projecting from a surface of the body portion 10 and an inwardly-pointed annular flange 112 on an end portion, away from the body portion 10, of the cylindrical portion 111; the cylindrical portion 111 defines a round inner hole 110 for fixing a receptacle 132 of a splicing assembly 13 described later. In order to increase the frictional force between the receptacle 132 and the inner hole 110, thus preventing the splicing assembly 13 from falling off, wall of the inner hole 110 of the splicing column 11, for example, is formed a rough surface.

Splicing holes 12 are round holes recessed from the surface of the body portion 10 opposite to the surface of the splicing columns 11, and the splicing columns 11 and the corresponding splicing holes 12 are arranged coaxially. Inner diameter of the splicing holes 12 is equal to or slightly larger than outer diameter of the splicing columns 11. Each splicing hole 12 and the inner hole 110 of each splicing column 11 are formed coaxially and communicated with each other to form a shoulder 15 therebetween.

In the embodiment, to achieve zero gap between two splicing blocks 1 spliced together, the depth of each splicing hole 12, for example, is equal to or slightly greater than the height of each splicing column 11.

Figure 2:
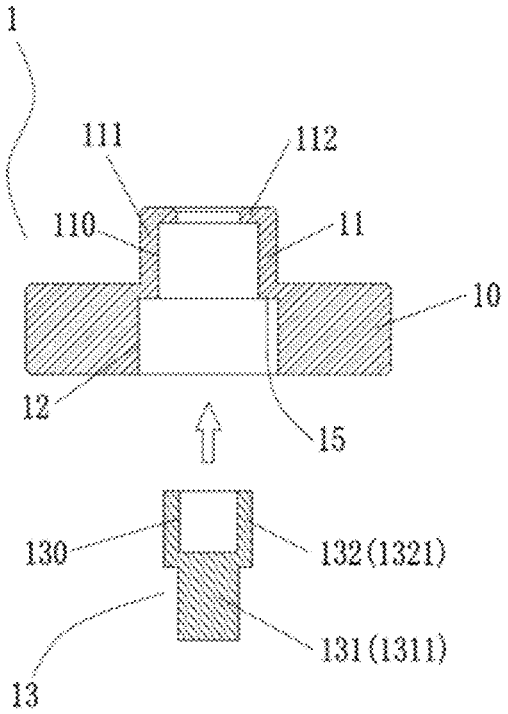
FIG. 2 shows a schematic sectional view of the splicing block and a splicing assembly of the splicing structure in the first embodiment.
Figure 3:
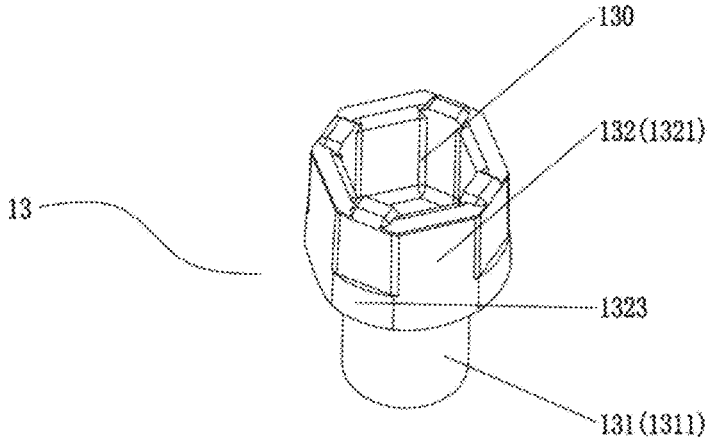
FIG. 3 is a space diagram showing a structure of the splicing assembly in the first embodiment.

As shown in FIGS. 2-3, the splicing assembly 13 has a plug piece 131 and a receptacle 132 arranged coaxially, and in this embodiment, the plug piece 131 and the receptacle 132 are formed integrally. The receptacle 132 is inserted into the inner hole 110 of the splicing column 11 by interference fit, thus achieving firm fixation of the splicing assembly 13. As the material for making the splicing assembly 13, it may be plastic (e.g., hard plastic), soft wood, etc.

The plug piece 131 includes an insertion rod 1311, and in this embodiment, the insertion rod is a cylindrical rod (see FIGS. 2-4), when the insertion rod is assembled with the body portion 10, it is coaxially disposed in the splicing hole 12 and has a gap which allows the splicing column 11 to insert with the inner wall of the splicing hole 12.

The receptacle 132 includes a sleeve 1321, bottom of the sleeve and one end of the insertion rod of the plug piece 131 are connected with the both two to form one body, and the sleeve 1321 is coaxially disposed within the inner hole 110 of the splicing column 11.

Figure 4:
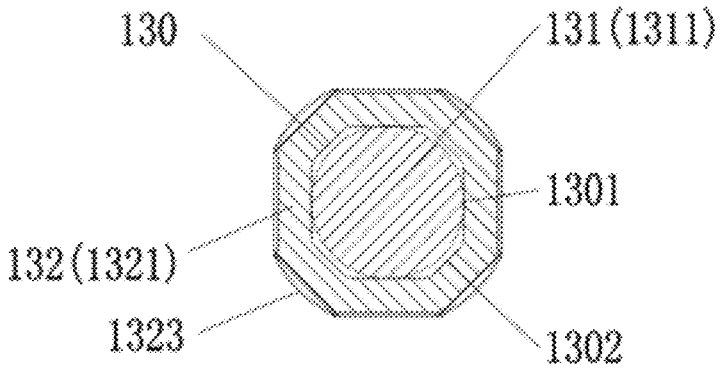
FIG. 4 is a sectional view showing a cross-sectional shape of a plug piece and a receptacle of the splicing assembly, where the plug piece is inserted into the receptacle.

The cross-sectional outline of the sleeve 1321 is square, and the junction of any two adjacent sides in the square may form a circular arc 1323. The curvature radius of the circular arc is, for example, roughly the same as or slightly larger than the radius of the inner hole 110 of the splicing column 11 (referring to FIGS. 3 and 4), and the formed circular arc surface extends along the entire axial length of the sleeve 1321. As an alternate embodiment, the cross-sectional outline of the sleeve 1321 may be the following structure: the cross-sectional outline of only a portion of the sleeve 1321 in axial length (such portion may be located in, for example, in the middle, bottom, upper part of the sleeve in axial direction, etc.) is square, and the junction of any two adjacent sides in the square may form a circular arc 1323, while the cross-sectional outline of other parts of the sleeve 1321 in axial length is octagonal. Thus, the formed circular arc surface extends along the partial axial length of the sleeve 1321. FIGS. 3 and 4 illustrate an example in which a portion, formed with a circular arc surface, of the sleeve 1321 is located at the bottom of the sleeve.

The sleeve 1321 has an insertion hole 130 allowing for the interference insertion of the insertion rod 1311 of the other splicing assembly 13 in its interior; the cross section of the insertion hole 130 is, for example, an inequilateral octagon, and the inequilateral octagon evolves from a square, including 4 long sides 1301 with equal length and 4 short sides 1302 with equal length, of which the 4 long sides 1301 with equal length are a part of side length of the square, and adjacent two of the 4 long sides are connected with the short side 1302 parallel to the diagonal of the square; side length of the square is, for example, slightly less than the diameter of the insertion rod 1311, thus achieving interference fit when the insertion rod 1311 is inserted into the insertion hole 130. By the technical solution, 4 long sides of the insertion hole 130 and the cross-sectional outline of the insertion rod 1311 form lineal contact when the insertion rod 1311 is inserted into the insertion hole 130, which may improve comfort level of hand feeling, reduce friction, prolong service life and increase productivity (referring to FIG. 4). As a solution, four sides of the cross-sectional outline of the sleeve 1321 are parallel to the 4 long sides of the insertion hole 130 respectively, and its effect will be described below.

During the assembly of the splicing block, as shown in FIG. 2, the receptacle 132 of the splicing assembly 13 is made through the splicing hole 12 and moved to an end portion of the inner hole 110 of the splicing column 110, the sleeve 1321 of the receptacle 132 is firmly pressed into the inner hole 110 until the sleeve 1321 is abutted against the flange 112, which achieves the fixation of the receptacle 132 and the splicing assembly 13 by means of the interference fit between the sleeve 1321 with the inner hole 110 of the splicing column 11, thus finishing the assembly and forming the splicing block 1.

During the assembly of the splicing structure, the splicing column 11 of a splicing block 1 is inserted into the splicing hole 12 of the other splicing block 1, and at this time, the insertion rod 1311 in the splicing hole 12 of the other splicing block 1 is inserted into the insertion hole 130 of the sleeve 1321 in the inner hole 110 of the one splicing block 1 along with the insertion direction (axial direction) by interference fit as the splicing column 11 is inserted into the splicing hole 12, so that two splicing blocks are jointed with each other firmly by means of the interference fit between the insertion rod 1311 and the insertion hole 130 of the sleeve 1321. A plurality of splicing blocks are spliced with each other in such a manner by the required shapes to form the splicing structure.

During the disassembly of the splicing structure, the splicing block 1 is pulled in/out to draw out the splicing column 11 from the splicing hole 12, thus achieving the disassembly of the splicing structure. At this time, the frictional force between the sleeve 1321 and the inner hole 110 of the splicing column 11 is greater than the frictional force between the insertion hole 130 of the sleeve 1321 and the insertion rod 1311, therefore, the receptacle 132 is firmly held in the inner hole 110 of the splicing column 11.

[Effect]

According to the above embodiment, the splicing block 1 is made of metal to bring natural metallic texture to the splicing block 1 and structural members spliced thereby, which meets the requirement of metallic texture in corresponding occasions. Moreover, the metal splicing block also has the advantages of high strength, no fading, aging resistance and the like, thus solving the problems of aging, fading and deformation existing in the conventional plastic splicing block very well.

In addition, the original exposed end face (upper end face in FIG. 1C) in the splicing assembly 13 can be covered by the flange 112 of the splicing column 11, thus avoiding the deformation of the splicing assembly 13 caused by collision and prolonging its service life. Furthermore, even if the side of the splicing column 11 becomes the appearance surface of the splicing structure after spliced, the splicing assembly 13 is blocked by the flange 112 as well, which may avoid that the appearance of the splicing structure is influenced by the splicing assembly (no blocking is also a solution available). In addition, the flange 112 further plays a spacing role to prevent the splicing assembly 13 from being over spliced during the assembly of splicing blocks.

In addition, the cross-sectional outline of the sleeve 1321 of the receptacle 132 is square, therefore, a certain gap may be reserved between the outer wall of the sleeve 1321 and the inner wall of the inner hole 110 of the splicing column 11 after splicing blocks are assembled, and the gap may enable the sleeve to have enough elasticity and magnitude of interference when inserted into the insertion rod, thus controlling the scope of the splicing intensity better. At the same time, the outline of the sleeve 1321 forms a circular arc surface, which is not only easy to install the sleeve 1321 of the receptacle 132 into the inner hole 110 of the splicing column 11, but also makes the mounted receptacle 132 free from shaking and offset, and moreover, controls the concentricity of each portion after splicing blocks are assembled very well and ensures uniform assembly force when the insertion rod 1311 is inserted into the sleeve 1321.

In addition, four long sides of the insertion hole 130 of the sleeve 1321 are respectively parallel to the four sides of the cross-sectional outline of the sleeve 1321, therefore, the peripheral wall of the sleeve 1321 easily suffers radial and outward elastic deformation while inserting the insertion rod 1311 into the insertion hole 130, accordingly, the insertion rod 1311 is easily inserted into the sleeve 1321 in an interference manner. Further, since the square hole is more prone to elastic deformation, the insertion rod 1311 and the sleeve 1321 requires relatively low accuracy on the magnitude of interference, and it is easier to achieve manufacture.

Second Embodiment

Hereinafter, the second embodiment of the disclosure is described with reference to FIG. 5.

Figure 5:
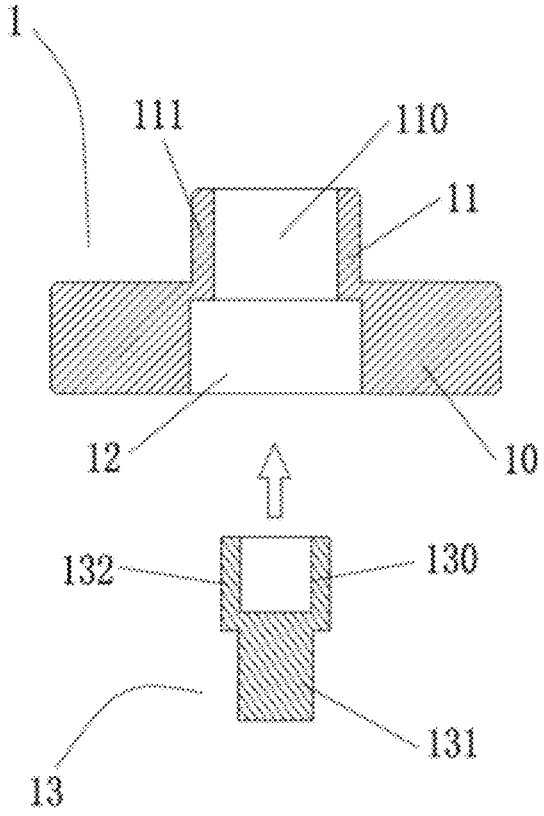
FIG. 5 shows a schematic sectional view of a splicing block and a splicing assembly of a splicing structure in a second embodiment.

In the first embodiment, the end far from body portion 10 of the cylindrical portion 111 of splicing column 11 has what is be directed inwardly toward Annular flange 112, and in the embodiment, as shown in FIG. 5, splicing column 11 does not have such flange 112, splicing column 11 Only include cylindrical portion 111.

Other structure of the splicing structure in the second embodiment is the same as the corresponding structure of the first embodiment, therefore, it will be not described repeatedly to avoid redundancy.

According to the embodiment, since the flange 112 is not provided, it is easier to achieve the manufacture of the splicing block 1.

Third Embodiment

Hereinafter, the third embodiment of the disclosure is described with reference to FIG. 6.

Figure 6:
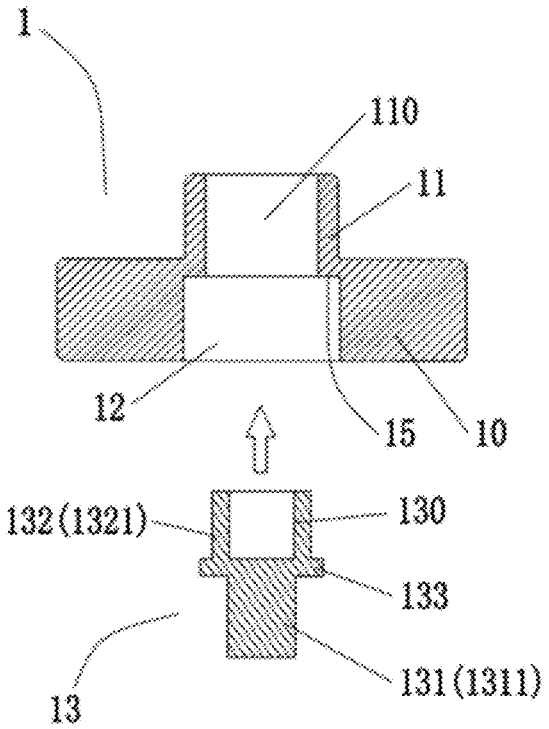
FIG. 6 shows a schematic sectional view of a splicing block and a splicing assembly of a splicing toy in a third embodiment.

As shown in FIG. 6, this embodiment is substantially the same as the second embodiment excepting for the structure of the splicing assembly 13. In this embodiment, an outwardly-pointed radial flange 133 is arranged between the sleeve 1321 of the receptacle 132 and the insertion rod 1311 of the plug piece.

Upon assembly of splicing blocks, the splicing assembly 13 is inserted as indicated by the arrows in the figure until the flange 133 is abutted against on the step surface of the shoulder 15 between the inner hole 110 of the splicing column 11 and the splicing hole 12. In the process, the sleeve 1321 is embedded into the inner hole 110 of the splicing column 11 in an interference manner after passing through the splicing hole 12, thus achieving the fixation of the splicing assembly 13; the insertion rod 1311 stays in the splicing hole 12. In order to achieve firm fixation of the splicing assembly 13, the outer diameter of the flange 133 may be slightly larger than the inner diameter of the splicing hole 12, so that the flange 133 is in interference fit with the splicing hole 12, thus making the fixation of the splicing assembly 13 more firm.

In addition, another difference of embodiment and second embodiment is: the depth of the splicing hole 12 is, for example, equal to or slightly greater than the sum of the height of the splicing column 11 and the axial height of the flange 133 in order to ensure that no gap is left between the spliced splicing blocks 1.

Other structure of the splicing toy in this third embodiment is the same as the corresponding structure in the second embodiment, therefore, it will be not described repeatedly to avoid redundancy.

According to the embodiment, the splicing assembly 13 is provided with the flange 133, therefore, the flange 133 serves for axial positioning, which prevents the splicing assembly 13 from being over spliced during the assembly of splicing blocks 1, and achieves further fixation by interference fit between the flange 133 and the splicing hole 12.

Fourth Embodiment

Hereinafter, the fourth embodiment of the disclosure is described with reference to FIG. 7.

Figure 7:
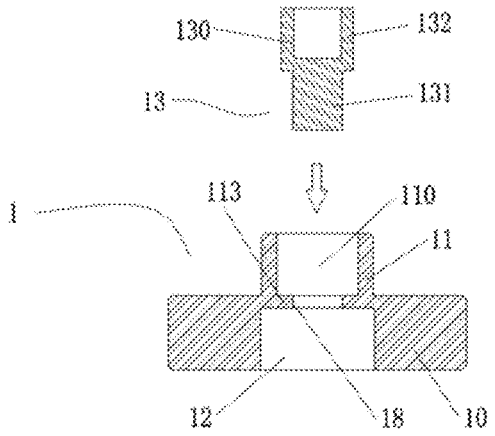
FIG. 7 is a schematic sectional view showing a splicing block and a splicing assembly of a splicing toy in a fourth embodiment.

As shown in FIG. 7, the difference between the embodiment and the second embodiment lies in that: a radially-inwardly-pointed annular flange 113 is formed at an end portion, close to the side of the splicing hole 12, of the inner hole 110 in the splicing column 11, and an axially-extending central hole 18 is formed at the center of the flange 113.

When splicing blocks are assembled, the splicing assembly 13 is inserted as indicated by the arrows in the figure until an end face of the side, connected with the plug piece 131, of the sleeve 1321 is abutted against on the inward flange 113. In the process, the insertion rod 1311 sequentially passes through the inner hole 110 and the central hole of the flange 113 and enters the splicing hole 12, and the sleeve 1321 is embedded into the inner hole 110 in an interference manner to realize the fixation of the splicing assembly 13; in addition, an interference fit may be applied between the insertion rod 1311 and the central hole of the flange 113, so that the plug piece 131 is fixed more firmly after splicing blocks are assembled.

Other structure of the splicing toy in this fourth embodiment is the same as the corresponding structure in the second embodiment, therefore, it will be not described repeatedly to avoid redundancy.

According to the embodiment, since the flange 113 is provided, it is possible to prevent the splicing assembly 13 from being over spliced during the assembly of splicing blocks 1 by means of the flange 113.

Fifth Embodiment

Hereinafter, the fifth embodiment of the disclosure is described with reference to FIG. 8.

In each of the embodiments described above, the plug piece 131 of the splicing assembly 13 is arranged in the splicing hole 12, while the receptacle 132 of the splicing assembly 13 is arranged in the inner hole 110 of the splicing column 11. In the embodiment as shown in FIG. 8, the plug piece 131 of the splicing assembly 13 is arranged in the inner hole 110 of the splicing column 11, while the receptacle 132 of the splicing assembly 13 is disposed in the splicing hole 12.

Figure 8:
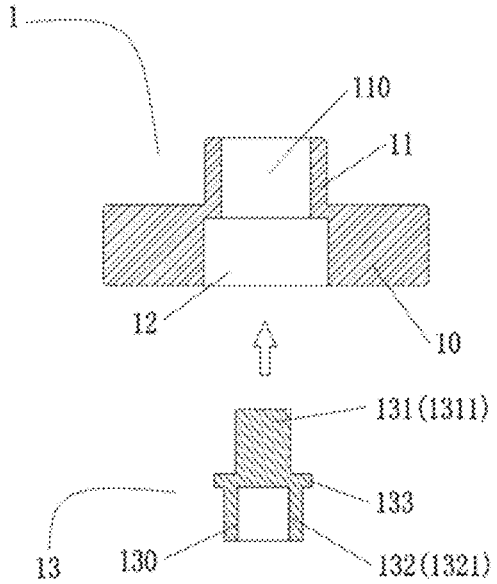
FIG. 8 is a schematic sectional view showing a splicing block and a splicing assembly of a splicing toy in a fifth embodiment.

As shown in FIG. 8, the splicing block 1 has a body portion 10, a splicing column 11, a splicing hole 12 and a splicing assembly 13 formed on the body portion 10.

The splicing column 11 is integrally formed on the body portion 10, and has an inner hole 110 communicated with the splicing hole 12 therein.

The splicing hole 12 is a round hole recessed from the surface of the body portion 10 opposite to the surface of the splicing column 11, and the splicing column 11 and the corresponding splicing hole 12 are arranged coaxially. Inner diameter of the splicing holes 12 is equal to or slightly larger than outer diameter of the splicing columns 11. The splicing hole 12 and the inner hole 110 of the splicing column 11 are coaxially formed and communicated with each other, the diameter of the splicing hole 12 is larger than that of the inner hole 110 of the splicing column 11, and a shoulder 15 is formed between the splicing hole 12 and the inner hole 110.

The splicing assembly 13 has a coaxially-formed plug piece 131, a radially outwardly-pointed flange 133, and a receptacle 132; the flange 133 is inserted into the splicing hole 12 in an interference manner, thus achieving firm fixation of the splicing assembly 13. Wall of the splicing hole 12 is, for example, a rough surface to increase the frictional force between the flange 133 and the splicing hole 12.

The plug piece 131 includes an insertion rod 1311, and in this embodiment, the insertion rod 1311 is a cylindrical rod and is coaxially disposed in the inner hole 110 of splicing column 11, moreover, a gap allowing the insertion of the sleeve 1321 of the receptacle 132 forms between the insertion rod 1311 and the inner wall of the inner hole 110.

The receptacle 132 includes a sleeve 1321, the bottom of the sleeve is integrally formed with one end of the flange 133. The sleeve 1321 is coaxially disposed in the splicing hole 12, and has a gap allowing the insertion of a cylindrical portion of the splicing column 11 with the inner wall of the splicing hole 12. The cross-sectional outline of the sleeve 1321 may be the cross-sectional outline of the sleeve in Embodiment 1. The sleeve 1321 is formed with an insertion hole 130 for interference insertion of the insertion rod 1311 of the other splicing assembly 13, and the insertion hole may be a structure of the insertion hole disclosed in Embodiment 1.

The cross-sectional outline of the flange 133 may be a polygon, and the junction of any two adjacent sides of the polygon forms a circular arc, and the curvature radius of the circular arc is, for example, roughly the same as or slightly larger than the radius of the splicing hole 12. The primary function of the flange 133 is to insert into the splicing hole 12 in an interference manner during the assembly of splicing blocks, thus achieving the fixation of the splicing assembly 13. Of course, the flange 133 also prevents the splicing assembly 13 being over spliced during the assembly of splicing blocks 1.

In addition, to make the splicing blocks 1 spliced together free from any gap, the depth of the splicing hole 12 is, for example, equal to or slightly greater than the sum of the height of the splicing column 11 and the height of the flange 133.

During the assembly of splicing blocks, the splicing assembly 13 is inserted as indicated by the arrows in the figure until the flange 133 is abutted against on the step surface of the shoulder between the inner hole 110 of the splicing column 11 and the splicing hole 12. In this process, the plug piece 131 enters the inner hole 110 after passing through the splicing hole 12, thus achieving the fixation of the splicing assembly 13 by interference fit between the flange 133 and the splicing hole 12, and the receptacle 132 stays in the splicing hole 12.

This embodiment is very practical in case that miniaturization of the splicing block is not strictly required.

Sixth Embodiment

Hereinafter, the sixth embodiment of the disclosure is described with reference to FIG. 9.

Figure 9:
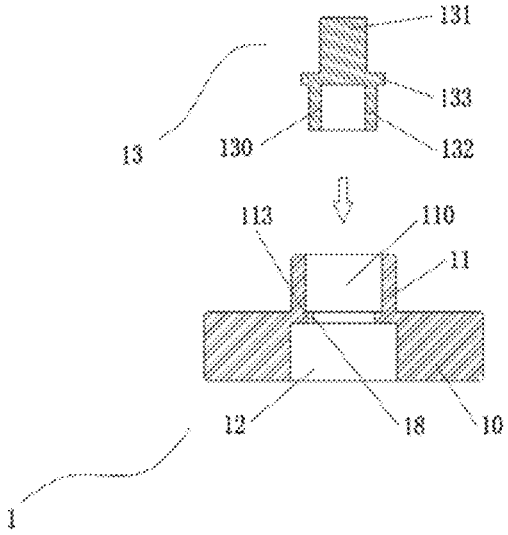
FIG. 9 is a schematic sectional view showing a splicing block and a splicing assembly of a splicing toy in a sixth embodiment.

As shown in FIG. 9, a radially-inwardly-pointed annular flange 113 is formed at an end portion, close to the side of the splicing hole 12, of the inner hole 110 in the splicing column 11, and an axially-extending central hole 18 is formed at the center of the flange 113.

In the fifth embodiment, the fixation of the splicing assembly 13 is achieved by interference fit between the flange 133 and the splicing hole 12. Different from the fifth embodiment, in this embodiment, and flange 133 is inserted into the inner hole 110 of the splicing column 11 in an interference manner, thus achieving the fixation of the splicing assembly 13 by interference fit between the flange 133 and the inner hole 110 of splicing column 11.

Accordingly, wall of the splicing hole 12 need not be a rough surface, but, for example, wall of the inner hole 110 of the splicing column 11 is configured as a rough surface, moreover, the inner hole 110 is, for example, a circular hole, and the depth of the splicing hole 12 is equal to or slightly greater than the height of the splicing column 11, which is also different from the fifth embodiment.

During the assembly of splicing blocks, the splicing assembly 13 is inserted as indicated by the arrows in the figure so that the receptacle 132 enters the splicing hole 12 after passing through the inner hole 110; the fixation of the splicing assembly 13 is achieved by interference fit between the flange 133 and the inner hole 110; the plug piece 131 remains in the inner hole 110. In addition, interference fit may be employed between the receptacle 132 and the central hole 18 of the flange 113, thus achieving more reliable fixation of the splicing assembly 13 after the assembly of splicing blocks.

Other structure of the splicing toy in the sixth embodiment is the same as the corresponding structure in the fifth embodiment, therefore, it will be not described repeatedly to avoid redundancy.

This embodiment is very practical in case that miniaturization of the splicing block is not strictly required.

Seventh Embodiment

Figure 10:
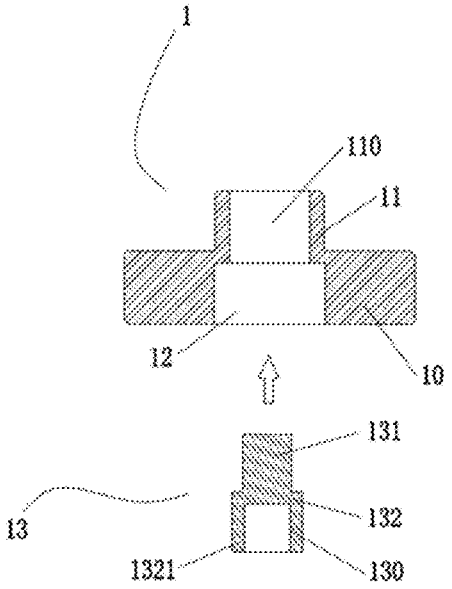
FIG. 10 is a schematic sectional view showing a splicing block and a splicing assembly of a splicing toy in a seventh embodiment.

Hereinafter, the seventh embodiment of the disclosure is described with reference to FIG. 10.

The seventh embodiment is structurally similar to the fifth embodiment, and the difference lies in that the splicing assembly 13 is not provided with a flange, and fixed by means of interference fit between the sleeve 1321 and the inner hole 110 of the splicing column 11; in this case, wall of the inner hole 110 of the splicing column 11 is, for example, a rough surface, thus increasing the frictional force between the sleeve 1321 and the inner hole 110 of the splicing column 11.

During the assembly of splicing blocks, the splicing assembly 13 is inserted as indicated by the arrows in the figure; the sleeve 1321 of the receptacle 132 is firmly pressed into the inner hole 110 by preset length, which achieves the fixation of the receptacle 132 and the splicing assembly 13 by means of the interference fit between the sleeve 1321 and the inner hole 110 of the splicing column 11, thus finishing the assembly and forming the splicing block 1.

This embodiment is very practical in case that miniaturization of the splicing block is not strictly required.

Eighth Embodiment

Figure 11A:
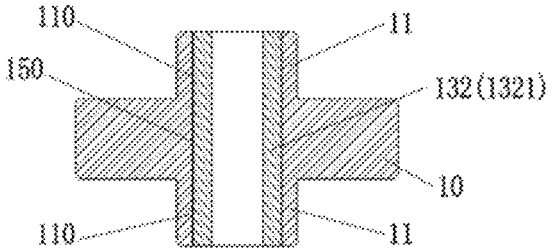
FIG. 11A is a schematic sectional view showing a splicing block and a receptacle of a splicing toy in an eighth embodiment.
Figure 11B:
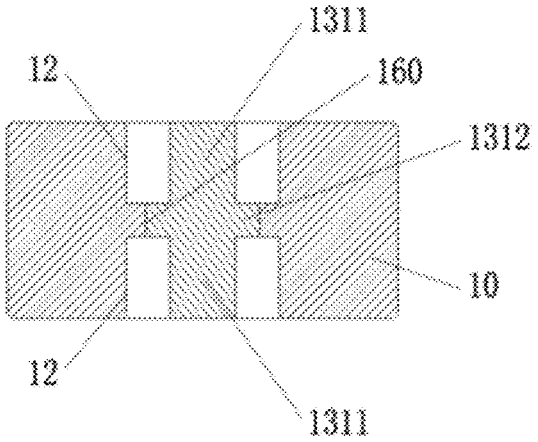
FIG. 11B is a schematic sectional view showing the other splicing block and plug piece of the splicing toy in the eighth embodiment.

In the foregoing embodiments, two oppose surfaces of the splicing block are provided with splicing columns and splicing holes respectively. In the embodiment, two oppose surfaces of the splicing block are provided with splicing columns or splicing holes. FIGS. 11A and 11B respectively illustrate the situation that two opposite surfaces of the splicing block are provided with splicing columns and splicing holes. As shown in FIG. 11A, two opposite surfaces of the splicing block are provided with splicing columns 11, inner holes 110 of the two splicing columns 11 are communicated with each other via an intercommunicating hole 150, and the intercommunicating hole 150 and inner holes 110 are arranged coaxially, and have the same inner diameter; a receptacle 132 includes a sleeve 1321.

During the assembly of splicing blocks, the sleeve 1321 is inserted via the inner hole 110 of a splicing column 11, both ends of the sleeve 1321 are respectively flush with the outer end portion of the splicing column, and the sleeve 1321 is fixed by interference fit with hole wall. The splicing block may be spliced with the other splicing block provided with a splicing hole, and a corresponding plug piece is arranged in the splicing hole of the other splicing block.

As shown in FIG. 11B, two opposite surfaces of the splicing block are provided with splicing holes 12, and the two splicing holes 12 are communicated with each other via the intercommunicating hole 160; the intercommunicating hole 160 is coaxially arranged with the two splicing holes 12; the plug piece 131 includes a cylindrical portion 1312 positioned centrally and insertion rods 1311 extending from two sides of the cylindrical portion respectively; insertion rods 1311 are coaxial with the cylindrical portion 1312.

During the assembly of splicing blocks, the plug piece 131 is inserted via a splicing hole 12, after insertion, end portions of the insertion rods 1311 are respectively flush with the outer surface of the splicing block; and the plug piece 131 is fixed by interference fit between the cylindrical portion 1312 and the intercommunicating hole 160. The splicing block may be spliced with the other splicing block provided with a splicing column, and a corresponding receptacle is arranged in the splicing column of the other splicing block. In this embodiment, diameter of the intercommunicating hole 160 may also be the same as that of the two splicing holes 12.

Ninth Embodiment

In the foregoing first to eighth embodiments, the splicing assembly 13 includes a plug piece 131 and a receptacle 132, and the plug piece 131 and the receptacle 132 are formed integrally. FIGS. 12A, 12B, 12C and 12D show the situation that the plug piece 131 and the receptacle 132 are separate components.

Figure 12A:
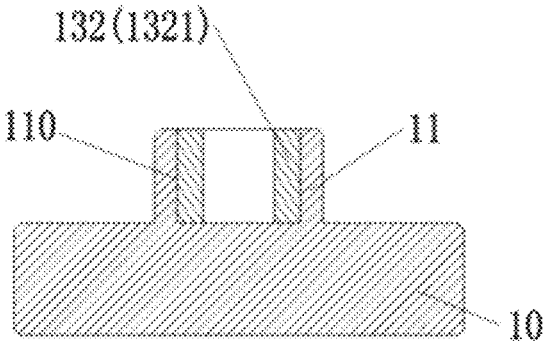
FIG. 12A is a schematic sectional view showing a splicing block and a receptacle of a splicing toy in a ninth embodiment.
Figure 12B:
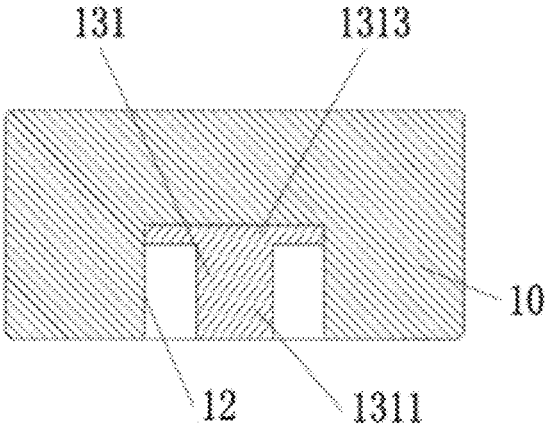
FIG. 12B is a schematic sectional view showing the other splicing block and plug piece of the splicing toy in the ninth embodiment.

As shown in FIG. 12A, one surface of the splicing block is provided with a splicing column 11; an inner hole 110 is formed in the splicing column 11. A receptacle 132 in the form of a sleeve is fixed in the inner hole 110 by interference fit. The splicing block may be spliced with the other splicing block provided with a splicing hole, and a corresponding plug piece is arranged in the splicing hole of the other splicing block. As shown in FIG. 12B, one surface of the splicing block is provided with splicing holes 12. The plug piece 131 includes an insertion rod 1311 and a flange 1313 located the inner end of the insertion rod, the outer diameter of the flange 1313 is substantially the same as the inner diameter of the splicing hole 12, and the plug piece 131 is fixed in the splicing holes by interference fit between the flange 1313 and the splicing hole. The splicing block may be spliced with the other splicing block provided with a splicing column, and a corresponding receptacle is arranged in the splicing column of the other splicing block.

Figure 12C:
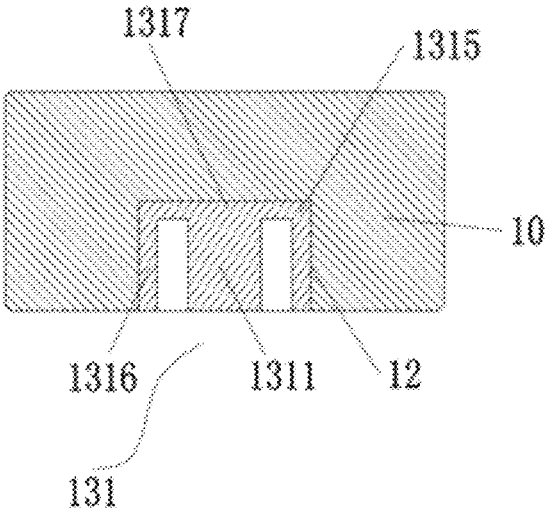
FIG. 12C is a schematic sectional view showing a further splicing block and plug piece of the splicing toy in the ninth embodiment.

As shown in FIG. 12C, one surface of the splicing block is provided with splicing holes 12. The plug piece 131 includes an insertion rod 1311 and a cap member 1315; the cap member 1315 includes a body portion 1316 and a bottom portion 1317 integrally formed with the body portion and located at the axial end portion of the body portion; the outer diameter of the body portion 1316 is substantially the same as the inner diameter of the splicing hole 12, and the plug piece 131 is fixed in the splicing hole by interference fit between the body portion 1316 and the splicing hole. The insertion rod 1311 is integrally formed with the cap member 1315, and one end is fixedly connected to the bottom portion 1317 and coaxial with the body portion 1316. The splicing block may be spliced with the other splicing block provided with a splicing column, and a corresponding receptacle is arranged in the splicing column of the other splicing block.

Figure 12D:
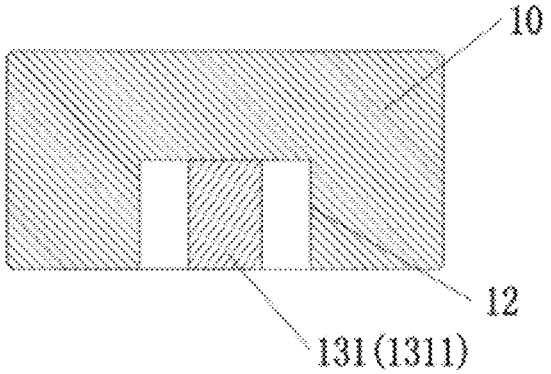
FIG. 12D is a schematic sectional view showing the other splicing block and plug piece of the splicing toy in the ninth embodiment.

As shown in FIG. 12D, one surface of the splicing block is provided with splicing holes 12. The plug piece 131 includes an insertion rod 1311, and in the embodiment, the insertion rod 1311 may be integrally formed with the body portion, or fixed in the splicing holes 12 by adhesive bonding, etc. The splicing block may be spliced with the other splicing block provided with a splicing column, and a corresponding receptacle is arranged in the splicing column of the other splicing block.

Tenth Embodiment

Figure 13A:
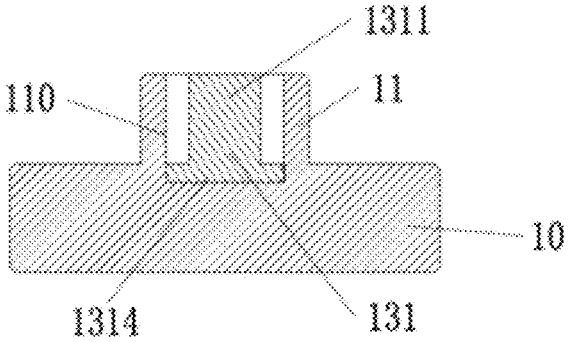
FIG. 13A is a schematic sectional view showing a splicing block and a plug piece of the splicing toy in a tenth embodiment.
Figure 13B:
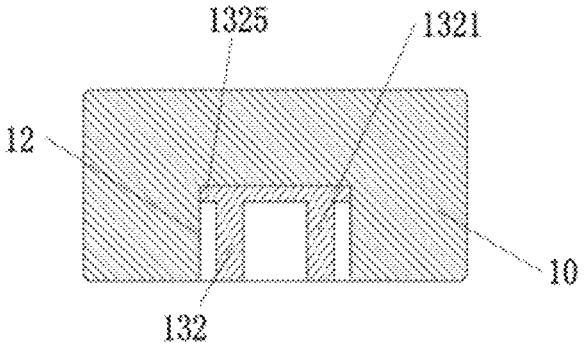
FIG. 13B is a schematic sectional view showing the other splicing block and receptacle of the splicing toy in the tenth embodiment.

FIGS. 13A and 13B show another situation that the plug piece 131 and the receptacle 132 are separate components.

As shown in FIG. 13A, one surface of the splicing block is provided with a splicing column 11, and inner holes 110 are formed on the splicing column 11. The plug piece 131 includes an insertion rod 1311 and a flange 1314 located in an inner end of the insertion rod; the outer diameter of the flange 1314 is substantially the same as the inner diameter of the inner holes 110; the plug piece 131 is fixed in the inner holes by interference fit between the flange 1314 and the inner holes 110. The splicing block may be spliced with the other splicing block provided with a splicing hole, and a corresponding receptacle is arranged in the splicing hole of the other splicing block. As shown in FIG. 13B, one surface of the splicing block is provided with splicing holes 12. The receptacle 132 includes a sleeve 1321 and a flange 1325 located the inner end of the sleeve, the outer diameter of the flange 1325 is roughly the same as the inner diameter of the splicing holes 12, and the receptacle 132 is fixed in the splicing hole by interference fit between the flange 1325 and the splicing hole. The splicing block may be spliced with the other splicing block provided with a splicing column, and a corresponding plug piece is arranged in the splicing column of the other splicing block.

For the embodiment as shown in FIG. 13A, the plug piece 131 may also be integrally formed with the body portion. For the embodiment as shown in FIG. 13B, the receptacle 132 may also be integrally formed with the body portion.

Eleventh Embodiment

Figure 14A:
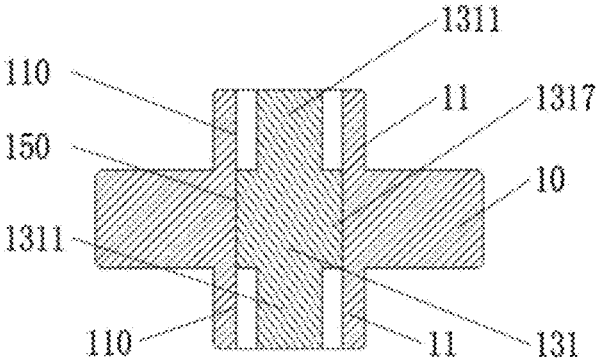
FIG. 14A is a schematic sectional view showing a splicing block and a plug piece of the splicing toy in an eleventh embodiment.
Figure 14B:
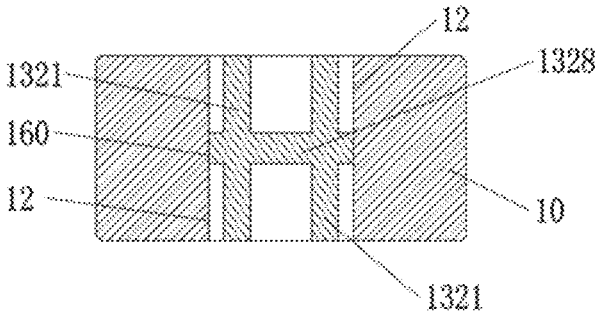
FIG. 14B is a schematic sectional view showing the other splicing block and receptacle of the splicing toy in the eleventh embodiment.
Figure 15A:
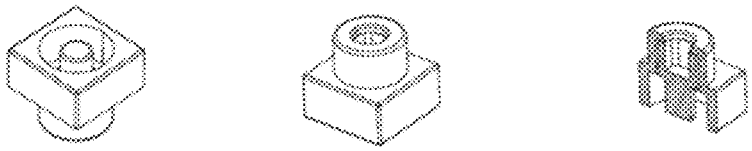
FIGS. 15A-15G respectively illustrate some examples of splicing blocks.
Figure 15B:
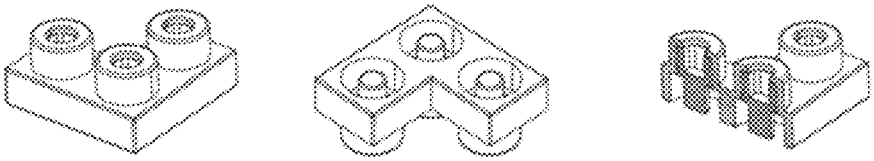
Figure 15C:
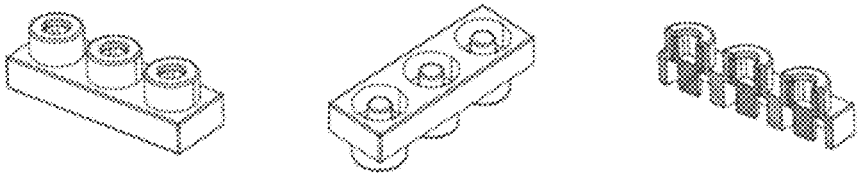
Figure 15D:
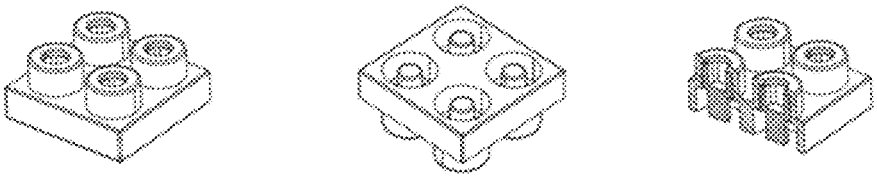
Figure 15E:
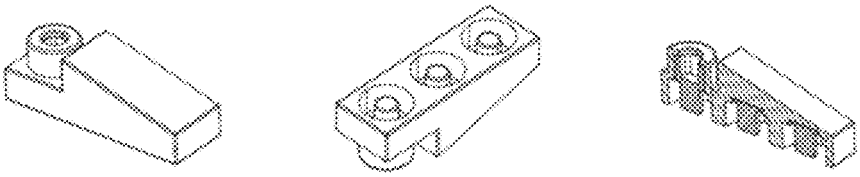
Figure 15F:
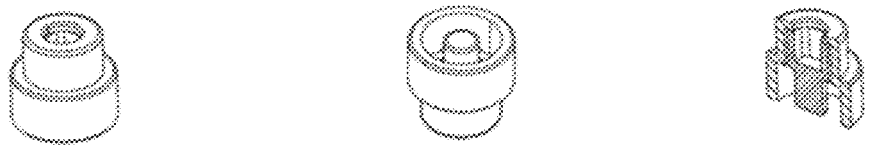
Figure 15G:
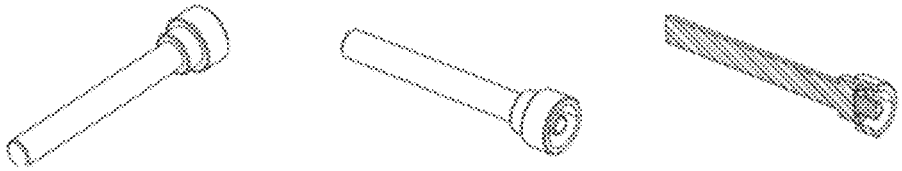
Figure 16A:
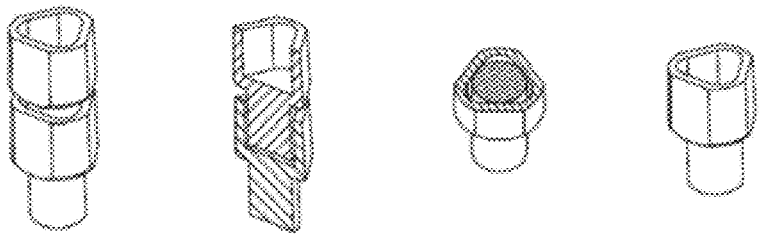
FIGS. 16A-16G respectively illustrate some examples of the cross-sectional outline of the receptacle (sleeve) and the shape of the insertion hole.
Figure 16B:
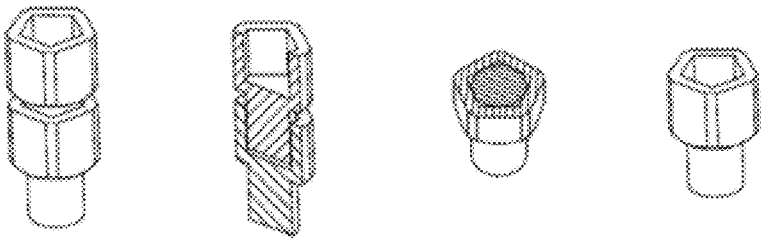
Figure 16C:
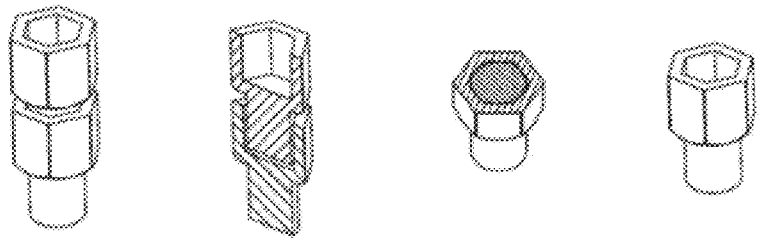
Figure 16D:
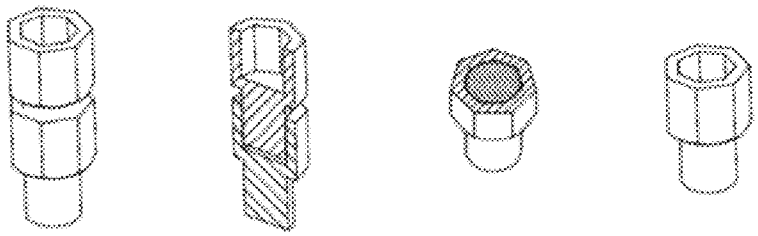
Figure 16E:
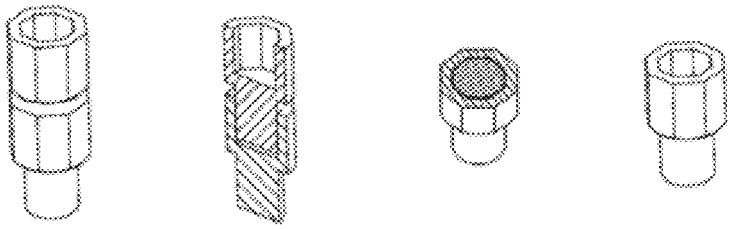
Figure 16F:
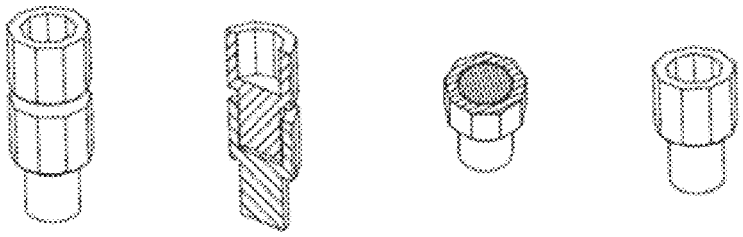
Figure 16G:
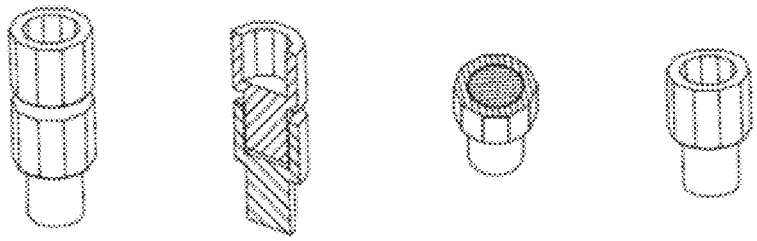
Figure 17A:
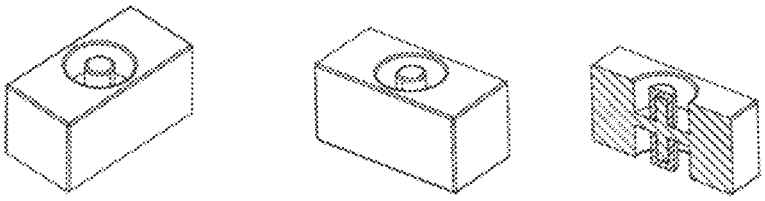
FIGS. 17A-17E respectively illustrate some examples showing layout forms of the splicing column and/or splicing hole on a body portion.
Figure 17B:
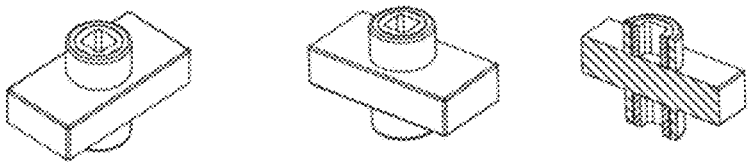
Figure 17C:
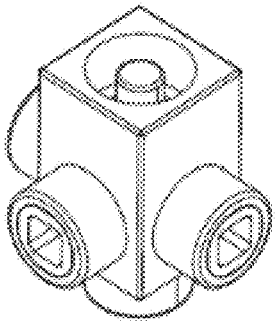
Figure 17D:
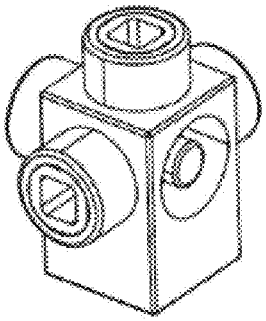
Figure 17E:
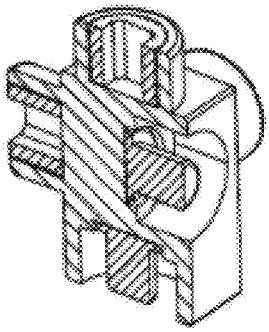

FIGS. 14A and 14B respectively illustrate the situation that two opposite surfaces of the splicing block are provided with splicing columns or splicing holes.

As shown in FIG. 14A, two opposite surfaces of the splicing block are provided with splicing columns 11, inner holes 110 of the two splicing columns 11 are communicated with each other via intercommunicating holes 150, and the intercommunicating holes 150 and inner holes 110 are arranged coaxially, and the inner diameter of the intercommunicating hole 150 is less than or equal to the inner diameter of the inner hole 110. The plug piece 131 includes a cylindrical portion 1317 located centrally and insertion rods 1311 extending outwardly from both sides of the cylindrical portion respectively, the insertion rods 1311 are coaxial with the cylindrical portion 1317.

During the assembly of splicing blocks, the plug piece 131 is inserted via an inner hole 110, after insertion, end portions of the insertion rods 1311 are respectively flush with outer surfaces of the splicing columns 11; and the plug piece 131 is fixed by interference fit between the cylindrical portion 1317 and the intercommunicating hole 150. The splicing block may be spliced with the other splicing block provided with a splicing hole, and a corresponding receptacle is arranged in the splicing hole of the other splicing block.

As shown in FIG. 14B, two opposite surfaces of the splicing block are provided with splicing holes 12, the two splicing holes 12 are communicated with each other via intercommunicating holes 160, and the intercommunicating holes 160 and splicing holes 12 are arranged coaxially, and the inner diameter of the intercommunicating hole 160 is less than or equal to the inner diameter of the splicing hole 12. The receptacle 132 includes a cylindrical portion 1328 located centrally and sleeves 1321 extending outwardly from both sides of the cylindrical portion respectively, the sleeves 1321 are coaxial with the cylindrical portion 1328.

During the assembly of splicing blocks, the receptacle 132 is inserted via a splicing hole 12, after insertion, end portions of the sleeves 1321 are respectively flush with outer surfaces of the splicing blocks; and the receptacle 132 is fixed by interference fit between the cylindrical portion 1328 and the intercommunicating hole. The splicing block may be spliced with the other splicing block provided with a splicing column, and a corresponding plug piece is arranged in the splicing column of the other splicing block.

Other Variations

Several embodiments of the disclosure have been described above, it may be appreciated by those skilled in the art that all the above description are merely examples, and various changes can be made within the scope of the technical thought of this disclosure, for example, the technical element in each embodiment is combined or non-essential technical element is removed therefrom on the premise of no contradiction, these changes shall be contained in the disclosure.

(1) In each of the embodiments above, the body portion 10 is cuboid-shaped. However, the disclosure is not limited thereto, and the body portion 10 may be formed in any expected shape, such as a plate, a rode, a cube, a cylinder, a trapezoid, a cone or a circular truncated cone, a petal shape, a rod-like shape, a ring shape, an L shape, or a tree shape, an animal shape, etc.; and some specific examples are illustrated in FIGS. 15A-15G. In addition, the body portion 10 may be further provided with any type of moldings, such as a tree molding, a flower molding, an animal molding, a fence molding or any other type of molding; required patterns may be formed on the body portion 10 by machining, etching, etc., or may be pasted on the body portion 10.

(2) In each of the embodiments above, each hole for achieving interference fit (the inner hole 110 in the splicing column 11, splicing hole 12 and the central hole 15) is a round hole, but the disclosure is not limited thereto, the hole for interference fit may be other shapes, such as polygon.

(3) In each of the embodiments above, wall of the each hole for achieving interference fit (the inner hole 110 in the splicing column 11, splicing hole 12 and the central hole 18, etc.) is a rough surface, but the disclosure is not limited thereto, the wall of the each hole for interference fit may also be a smooth surface.

(4) In each of the embodiments above, the insertion hole 130 is a closed annular hole in circumferential direction, but the disclosure is not limited thereto, and the insertion hole 130 may not be closed in the circumferential direction.

(5) In each of the embodiments above, the cross-sectional outline of the receptacle 132 and/or the sleeve 1321 is square and the cross section of the insertion hole 130 is an inequilateral octagon and the sides thereof are parallel to each other, but the disclosure is not limited thereto, and the sides thereof may not be parallel. Moreover, the cross-sectional outline of the receptacle 132 and/or the sleeve 1321 as well as the cross section of the insertion hole 130 may be the same shape or different shapes; in the case of the same shape, the sides thereof may or may not be parallel. In addition, the cross-sectional outline of the receptacle 132 and/or the sleeve 1321 as well as the cross section of the insertion hole 130 may be circular. FIGS. 16 A-16G illustrate some specific examples of the cross-sectional outline of the receptacle 132 and/or the sleeve 1321 as well as the shape of the insertion hole 130 respectively, and in these examples, the cross-sectional outline of the receptacle 132 and/or the sleeve 1321 as well as the section shape of the insertion hole 130 are triangular, pentagonal, and polygonal respectively.

(6) In each of the embodiments above, the insertion rod 1311 is cylindrical, but the disclosure is not limited thereto; the insertion rod 1311 may be a prism, or may be a tubular piece having an axial hole.

(7) In each of the embodiments above, the splicing assembly 13, the plug piece 131, or the receptacle 132 is fixed by interference fit, but the disclosure is not limited thereto; and the splicing assembly 13, the plug piece 131, or the receptacle 132 may be fixed by adhesive binding, etc., or, may be fixed on the basis of interference fit with the aid of adhesive bonding. Further, the splicing assembly 13, the plug piece 131, or the receptacle 132 may be formed integrally with the body portion if applicable.

(8) In some embodiments above, one side of the body portion 10 is provided with a splicing column 11, while the opposite side is provided with a splicing hole 12, and the corresponding splicing column and splicing hole are arranged coaxially, but the disclosure is not limited thereto; the following various solutions are all feasible: one of the body portion is provided with splicing columns only; one side of the body portion is provided with splicing holes only; one side of the body portion is provided with splicing columns, while the another opposite side thereof is provided with splicing holes, and one side of the splicing columns and the other side of splicing holes may be coaxial or not coaxial; both splicing columns and splicing holes are arranged on the same side; both splicing columns are arranged on the opposite two sides of the body portion or splicing holes are arranged on the opposite two sides of the body portion; splicing columns and/or splicing holes may be arranged on either side of the body portion, etc., FIGS. 17A-17E illustrate some examples.

(9) Multiple embodiments have been described in the description, and the features described in a certain embodiment may be used in other embodiments by combination, for example, the structural features associated with the receptacle and/or sleeve of the splicing assembly described in Embodiment 1 may be used in the receptacle and/or sleeve of other embodiments.

What is said above is merely exemplary examples of the disclosure and is not intended to limit the scope of the disclosure, and the protection scope of the disclosure is defined by the claims appended.

INDUSTRIAL APPLICABILITY

The disclosure may be widely applied in the fields, such as toy, tool, furniture, and handicraft.

The invention claimed is:

1. A splicing structure, comprising:

at least two splicing blocks which are detachably spliced together, wherein a splicing hole is arranged in one of the two splicing blocks which are spliced with each other, the other splicing block is provided with a splicing column which can be inserted into the splicing hole, and the splicing column is provided with an inner hole extending in an axial direction thereof;

characterized in that, the splicing structure further comprises:

a plug piece having an insertion rod;

a receptacle having a sleeve, and an insertion hole is formed on the sleeve; the plug piece is fixedly mounted in one of the inner hole of the splicing column and the splicing hole, and the receptacle is fixedly mounted in the other of the inner hole of the splicing column and the splicing hole; when the two splicing blocks are spliced by inserting the splicing column into the splicing hole, the insertion rod is inserted into the insertion hole by interference fit to joint the two splicing blocks together;

a frictional force between the sleeve and the inner hole of the splicing column is greater than a frictional force between the insertion hole of the sleeve and the insertion rod.

2. The splicing structure according to claim 1, characterized in that the plug piece is fixedly mounted in the splicing hole, while the receptacle is fixedly mounted in the inner hole of the splicing column.

3. The splicing structure according to claim 2, characterized in that the one splicing block is further provided with the splicing column, and the receptacle is fixedly mounted in the inner hole of the splicing column.

4. The splicing structure according to claim 2, characterized in that the other splicing block is further provided with the splicing hole, and the plug piece is fixedly mounted in the splicing hole.

5. The splicing structure according to claim 3, characterized in that the other splicing block is further provided with the splicing hole, and the plug piece is fixedly mounted in the splicing hole.

6. The splicing structure according to claim 3, characterized in that the splicing hole and the splicing column on the same splicing block are arranged coaxially, the inner hole of the splicing column is communicated with and coaxial with the splicing hole, and the receptacle in the inner hole is integrally formed with the plug piece in the splicing hole.

7. The splicing structure according to claim 6, characterized in that the sleeve of the receptacle is inserted into the inner hole, and fixed by interference fit between the sleeve and the inner hole.

8. The splicing structure according to claim 6, characterized in that an inwardly-pointed annular flange is formed on an end portion, away from the splicing hole, of the splicing column.

9. The splicing structure according to claim 6, characterized in that an outwardly-pointed annular flange is formed in a portion where the receptacle and the plug piece are connected with each other, and the annular flange is abutted against on a step surface between the inner hole of the splicing column and the splicing hole after assembled.

10. The splicing structure according to claim 6, characterized in that an inwardly-pointed annular flange is formed on an end portion in side of the inner hole, close to the splicing hole, of the splicing column, and an end face of the side, connected with the plug piece, of the sleeve of the receptacle is abutted against on the annular flange after assembled.

11. The splicing structure according to claim 7, characterized in that cross-sectional outline of the sleeve of the receptacle is a polygon, and the inner hole is a round hole.

12. The splicing structure according to claim 11, characterized in that junction of two adjacent sides in the cross-sectional outline of the polygon forms a circular arc.

13. The splicing structure according to claim 12, characterized in that curvature radius of the circular arc is equal to or slightly greater than radius of the inner hole.

14. The splicing structure according to claim 12, characterized in that the insertion hole of the receptacle is polygonal.

15. The splicing structure according to claim 14, characterized in that the cross-sectional outline of the sleeve is a polygon similar to the insertion hole, and the corresponding sides of the both two are parallel to each other.

16. The splicing structure according to claim 15, characterized in that the cross-sectional outline of the sleeve of the receptacle is a square, while the insertion hole of the receptacle is inequilaterally octagonal; inequilateral octagon comprises four long sides with equal length and four short sides with equal length, each of long sides is respectively parallel to each side of the square outline of the sleeve of the receptacle.

17. The splicing structure according to claim 16, characterized in that the insertion rod is a cylindrical rod.

18. The splicing structure according to claim 2, characterized in that the sleeve of the receptacle is inserted into the inner hole of the splicing column, and fixed by interference fit between the sleeve and the inner hole.

19. The splicing structure according to claim 2, characterized in that the other splicing block is further provided with the other splicing column, and the receptacle is fixedly mounted in the inner hole of each splicing column.

20. The splicing structure according to claim 19, characterized in that the sleeve of the receptacle is inserted into the inner hole of the splicing column, and fixed by interference fit between the sleeve and the inner hole.

21. The splicing structure according to claim 19, characterized in that splicing columns arranged on the other splicing block are coaxially arranged, inner holes of the two splicing columns arranged coaxially are communicated with each other via an intercommunicating hole, and the intercommunicating hole is coaxial with the inner hole and has the diameter equal to or greater than that of the inner hole, and the sleeve of the receptacle is inserted into the inner hole of the splicing column and the intercommunicating hole, and is fixed by interference fit between the sleeve and the inner hole and/or the intercommunicating hole.

22. The splicing structure according to claim 2, characterized in that the plug piece comprises a flange fixed on one end of the insertion rod, and the flange is inserted into the splicing hole, and the plug piece is fixed by interference fit between the flange and the splicing hole.

23. The splicing structure according to claim 2, characterized in that the one splicing block is further provided with the other splicing hole, and plastic plug piece is fixedly mounted in each splicing hole.

24. The splicing structure according to claim 23, characterized in that the plug piece comprises a flange fixed on one end of the insertion rod, and the flange is inserted into the splicing hole, and the plug piece is fixed by interference fit between the flange and the splicing hole.

25. The splicing structure according to claim 23, characterized in that splicing holes separately arranged on the one splicing block are arranged coaxially, and the two coaxially-arranged splicing holes are communicated with each other via an intercommunicating hole; the plug piece comprises a cylindrical portion located centrally and an insertion rod stretching out from both sides of the cylindrical portion respectively, each insertion rod is coaxial with the cylindrical portion; the cylindrical portion of the plug piece is inserted into the intercommunicating hole, and is fixed by interference fit between the cylindrical portion and the intercommunicating hole.

26. The splicing structure according to claim 2, characterized in that the plug piece comprises the insertion rod and a cap member, and the cap member comprises a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

27. The splicing structure according to claim 2, characterized in that the splicing hole is respectively arranged at both sides of the one splicing block, and plastic plug piece is fixedly mounted in each splicing hole.

28. The splicing structure according to claim 27, characterized in that the plug piece comprises the insertion rod and a cap member, and the cap member comprises a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

29. The splicing structure according to claim 1, characterized in that the plug piece is fixedly mounted in the inner hole of the splicing column, while the receptacle is fixedly mounted in the splicing hole.

30. The splicing structure according to claim 29, characterized in that the one splicing block is further provided with the splicing column, and the plug piece is fixedly mounted in the inner hole of the splicing column.

31. The splicing structure according to claim 29, characterized in that the other splicing block is further provided with the splicing hole, and the receptacle is fixedly mounted in the splicing hole.

32. The splicing structure according to claim 30, characterized in that the other splicing block is further provided with the splicing hole, and the receptacle is fixedly mounted in the splicing hole.

33. The splicing structure according to claim 30, characterized in that the splicing hole and splicing column on the same splicing block are arranged coaxially, the inner hole of the splicing column is communicated with and coaxial with the splicing hole, and the plug piece in the inner hole is integrally formed with the receptacle in the splicing hole.

34. The splicing structure according to claim 33, characterized in that an outwardly-pointed annular flange is formed in a portion where the receptacle and the plug piece are connected with each other, and the annular flange is inserted into the splicing hole or the inner hole by interference fit to fix the receptacle and the plug piece on the splicing block.

35. The splicing structure according to claim 34, characterized in that cross-sectional outline of the annular flange is a polygon.

36. The splicing structure according to claim 35, characterized in that the splicing hole or the inner hole is a round hole.

37. The splicing structure according to claim 36, characterized in that junction of two adjacent sides in the cross-sectional outline of the polygon forms a circular arc.

38. The splicing structure according to claim 37, characterized in that curvature radius of the circular arc is roughly the same as radius of the splicing hole or the inner hole.

39. The splicing structure according to claim 34, characterized in that the cross-sectional outline of the receptacle is a polygon similar to the insertion hole of the receptacle, and the corresponding sides of the both two are parallel to each other.

40. The splicing structure according to claim 39, characterized in that the polygon is a square.

41. The splicing structure according to claim 39, characterized in that the insertion rod is a cylindrical rod.

42. The splicing structure according to claim 33, characterized in that a portion, close to the plug piece, of the sleeve of the receptacle, is inserted into the inner hole of the splicing column by interference fit, thus making the receptacle and plug piece fixed on the splicing block.

43. The splicing structure according to claim 42, characterized in that the cross-sectional outline of the sleeve of the receptacle is a polygon.

44. The splicing structure according to claim 43, characterized in that junction of two adjacent sides in the cross-sectional outline of the polygon forms a circular arc.

45. The splicing structure according to claim 44, characterized in that curvature radius of the circular arc is roughly the same as radius of the inner hole of the splicing column.

46. The splicing structure according to claim 44, characterized in that the insertion hole of the receptacle is a polygonal hole.

47. The splicing structure according to claim 46, characterized in that the cross-sectional outline of the sleeve is a polygon similar to the polygonal hole, and the corresponding sides of the both two are parallel to each other.

48. The splicing structure according to claim 47, characterized in that the cross-sectional outline of the sleeve of the receptacle is a square, while the insertion hole of the receptacle is inequilaterally octagonal; inequilateral octagon comprises four long sides with equal length and four short sides with equal length, each of long sides is respectively parallel to each side of the square outline of the sleeve of the receptacle.

49. The splicing structure according to claim 48, characterized in that the insertion rod is a cylindrical rod.

50. The splicing structure according to claim 29, characterized in that a flange is arranged on an inner end of the sleeve of the receptacle, and the flange is inserted into the splicing hole, and the receptacle is fixed by interference fit between the flange and the splicing hole.

51. The splicing structure according to claim 29, characterized in that the one splicing block is further provided with the other splicing hole, and plastic receptacle is fixedly mounted in each splicing hole.

52. The splicing structure according to claim 51, characterized in that a flange is arranged on an inner end of the sleeve of the receptacle, and the flange is inserted into the splicing hole, and the receptacle is fixed by interference fit between the flange and the splicing hole.

53. The splicing structure according to claim 51, characterized in that splicing holes separately arranged on the one splicing block are arranged coaxially, and the two coaxially-arranged splicing holes are communicated with each other via an intercommunicating hole; the intercommunicating hole is coaxial with the splicing hole and its diameter is equal to or smaller than that of the splicing hole; the receptacle comprises a cylindrical portion located centrally and a sleeve stretching out from both sides of the cylindrical portion respectively, each sleeve is coaxial with the cylindrical portion, and the cylindrical portion of the receptacle is inserted into the intercommunicating hole, and is fixed by interference fit between the cylindrical portion and the intercommunicating hole.

54. The splicing structure according to claim 29, characterized in that the plug piece comprises a flange fixed on one end of the insertion rod, and the flange is inserted into the inner hole of the splicing column, and the plug piece is fixed by interference fit between the flange and the inner hole.

55. The splicing structure according to claim 29, characterized in that the other splicing block is further provided with the other splicing column, and plastic plug piece is fixedly mounted in the inner hole of each splicing column.

56. The splicing structure according to claim 55, characterized in that the plug piece comprises a flange fixed on one end of the insertion rod, and the flange is inserted into the inner hole of the splicing column, and the plug piece is fixed by interference fit between the flange and the inner hole.

57. The splicing structure according to claim 55, characterized in that splicing columns separately arranged on the other splicing block are arranged coaxially, and inner holes of the two coaxially-arranged splicing columns are communicated with each other via an intercommunicating hole; the intercommunicating hole is coaxial with the inner hole and its diameter is equal to or smaller than that of the inner hole; the plug piece comprises a cylindrical portion located centrally and insertion rods stretching out from both sides of the cylindrical portion respectively, each insertion rod is coaxial with the cylindrical portion, and the cylindrical portion of the plug piece is inserted into the intercommunicating hole, and is fixed by interference fit between the cylindrical portion and the intercommunicating hole.

58. The splicing structure according to claim 1, characterized in that each of the two mutually-spliced splicing blocks is provided with a splicing hole and a splicing column, and the two splicing blocks may be spliced by position exchange.

59. The splicing structure according to claim 1, characterized in that the plug piece and the receptacle are made of plastic or soft wood.

60. The splicing structure according to claim 1, characterized in that the plug piece and/or the receptacle are integrally formed with the splicing block.

61. The splicing structure according to claim 1, characterized in that the receptacle and/or plug piece are fixed by interference fit and/or adhesive bonding.

62. The splicing structure according to claim 1, characterized in that the splicing block is made of a metallic or non-metallic material.

63. The splicing structure according to claim 1, characterized in that cross-sectional outline of the sleeve of the receptacle is a polygon.

64. The splicing structure according to claim 1, characterized in that junction of two adjacent sides in cross-sectional outline of polygon forms a circular arc.

65. The splicing structure according to claim 63, characterized in that the insertion hole of the receptacle is polygonal.

66. The splicing structure according to claim 65, characterized in that cross-sectional outline of the sleeve is a polygon similar to the insertion hole, and the corresponding sides of both two are parallel to each other.

67. The splicing structure according to claim 65, characterized in that the cross-sectional outline of the sleeve of the receptacle is a square, while the insertion hole of the receptacle is inequilaterally octagonal; inequilateral octagon comprises four long sides with equal length and four short sides with equal length, each of long sides is respectively parallel to each side of the square outline of the sleeve of the receptacle.

68. The splicing structure according to claim 65, characterized in that the insertion rod is a cylindrical rod, when two splicing blocks are spliced together, the cylindrical rod contacts with each sideline of the polygonal insertion hole.

69. The splicing structure according to claim 4, characterized in that the splicing hole and the splicing column on the same splicing block are arranged coaxially, the inner hole of the splicing column is communicated with and coaxial with the splicing hole, and the receptacle in the inner hole is integrally formed with the plug piece in the splicing hole.

70. The splicing structure according to claim 5, characterized in that the splicing hole and the splicing column on the same splicing block are arranged coaxially, the inner hole of the splicing column is communicated with and coaxial with the splicing hole, and the receptacle in the inner hole is integrally formed with the plug piece in the splicing hole.

71. The splicing structure according to claim 3, characterized in that the sleeve of the receptacle is inserted into the inner hole of the splicing column, and fixed by interference fit between the sleeve and the inner hole.

72. The splicing structure according to claim 4, characterized in that the sleeve of the receptacle is inserted into the inner hole of the splicing column, and fixed by interference fit between the sleeve and the inner hole.

73. The splicing structure according to claim 5, characterized in that the sleeve of the receptacle is inserted into the inner hole of the splicing column, and fixed by interference fit between the sleeve and the inner hole.

74. The splicing structure according to claim 3, characterized in that the plug piece comprises a flange fixed on one end of the insertion rod, and the flange is inserted into the splicing hole, and the plug piece is fixed by interference fit between the flange and the splicing hole.

75. The splicing structure according to claim 4, characterized in that the plug piece comprises a flange fixed on one end of the insertion rod, and the flange is inserted into the splicing hole, and the plug piece is fixed by interference fit between the flange and the splicing hole.

76. The splicing structure according to claim 5, characterized in that the plug piece comprises a flange fixed on one end of the insertion rod, and the flange is inserted into the splicing hole, and the plug piece is fixed by interference fit between the flange and the splicing hole.

77. The splicing structure according to claim 3, characterized in that the plug piece comprises the insertion rod and a cap member, and the cap member comprises a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

78. The splicing structure according to claim 4, characterized in that the plug piece comprises the insertion rod and a cap member, and the cap member comprises a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

79. The splicing structure according to claim 5, characterized in that the plug piece comprises the insertion rod and a cap member, and the cap member comprises a tubular body portion and a bottom portion which is integrally formed with the body portion and positioned at an axial end portion of the body portion; the insertion rod is fixed on the bottom portion and coaxial with the body portion, and the cap member is inserted into the splicing hole, and the plug piece is fixed by interference fit between the body portion and the splicing hole.

80. The splicing structure according to claim 31, characterized in that the splicing hole and splicing column on the same splicing block are arranged coaxially, the inner hole of the splicing column is communicated with and coaxial with the splicing hole, and the plug piece in the inner hole is integrally formed with the receptacle in the splicing hole.

81. The splicing structure according to claim 32, characterized in that the splicing hole and splicing column on the same splicing block are arranged coaxially, the inner hole of the splicing column is communicated with and coaxial with the splicing hole, and the plug piece in the inner hole is integrally formed with the receptacle in the splicing hole.

82. The splicing structure according to claim 30, characterized in that a flange is arranged on an inner end of the sleeve of the receptacle, and the flange is inserted into the splicing hole, and the receptacle is fixed by interference fit between the flange and the splicing hole.

83. The splicing structure according to claim 31, characterized in that a flange is arranged on an inner end of the sleeve of the receptacle, and the flange is inserted into the splicing hole, and the receptacle is fixed by interference fit between the flange and the splicing hole.

84. The splicing structure according to claim 32, characterized in that a flange is arranged on an inner end of the sleeve of the receptacle, and the flange is inserted into the splicing hole, and the receptacle is fixed by interference fit between the flange and the splicing hole.

85. The splicing structure according to claim 30, characterized in that the plug piece comprises a flange fixed on one end of the insertion rod, and the flange is inserted into the inner hole of the splicing column, and the plug piece is fixed by interference fit between the flange and the inner hole.

86. The splicing structure according to claim 31, characterized in that the plug piece comprises a flange fixed on one end of the insertion rod, and the flange is inserted into the inner hole of the splicing column, and the plug piece is fixed by interference fit between the flange and the inner hole.

87. The splicing structure according to claim 32, characterized in that the plug piece comprises a flange fixed on one end of the insertion rod, and the flange is inserted into the inner hole of the splicing column, and the plug piece is fixed by interference fit between the flange and the inner hole.

* * * * *